United States Patent [19]

McCullough et al.

[11] 4,245,946

[45] Jan. 20, 1981

[54] APPARATUS FOR REMOVING BAGS FROM STACKED CAN ENDS

[75] Inventors: Davey L. McCullough, Golden; R. Wayne Rouse, Conifer, both of Colo.

[73] Assignee: Adolph Coors Company, Golden, Colo.

[21] Appl. No.: 939,882

[22] Filed: Sep. 5, 1978

[51] Int. Cl.[3] ..... B65B 21/02

[52] U.S. Cl. ..... 414/412; 414/417

[58] Field of Search ..... 414/411, 412, 416, 417

[56] References Cited

U.S. PATENT DOCUMENTS

| | | | |
|---|---|---|---|
| 3,266,541 | 8/1966 | Kluytenoar et al. | 414/412 |
| 3,441,156 | 4/1969 | Bofinger et al. | 414/412 |
| 3,686,820 | 8/1972 | Zenger et al. | 414/412 |
| 4,158,417 | 6/1979 | Inoue | 414/412 |

FOREIGN PATENT DOCUMENTS

| | | | |
|---|---|---|---|
| 2010771 | 7/1979 | United Kingdom | 414/412 |

*Primary Examiner*—Lawrence J. Oresky

*Attorney, Agent, or Firm*—Bruce G. Klaas; Dennis K. Shelton; Richard D. Law

[57] ABSTRACT

Apparatus for separating a wrapper from articles contained therein and especially applicable to the manufacture of cans wherein the can ends are formed at one location and transferred in bags of stacked ends to another location where the bags are removed and the ends are joined to the can bodies. Wrapped articles are laterally received in a receiving structure; the wrapped articles therein are longitudinally positioned so that an end of the wrapper is clamped by a clamping structure; a rod penetrates the wrapper and engages the articles therein; and transporting structure to transport the clamping structure and the wrapper clamped therein relative to the rod to separate the wrapper from the articles, which are retained in the receiving structure. The preferred structure includes a receiving means comprising a spring-loaded pair of angled members which form a receiving pocket extending substantially the length of the wrapped articles; a positioning structure comprising a cylinder for longitudinal movement of the wrapped articles; clamping structure comprising cylinder actuated opposing circumferential clamps and a plate structure longitudinally engagable with the clamps; and transporting structure comprising a drive shaft and a linear actuator for longitudinal movement of the clamping structure.

12 Claims, 11 Drawing Figures

190
186
178
200
216
195
214
184
188
220
182
202
180
3
3
226
192
196
308
166
24
154
48
160
168
152
162
156
150
197
212
158
104
210
194
159
174
148
208
170
176
310
164
172
38
30
102
110
106
134
126
12
224
128
16
218
204
228
206
222

Fig-8
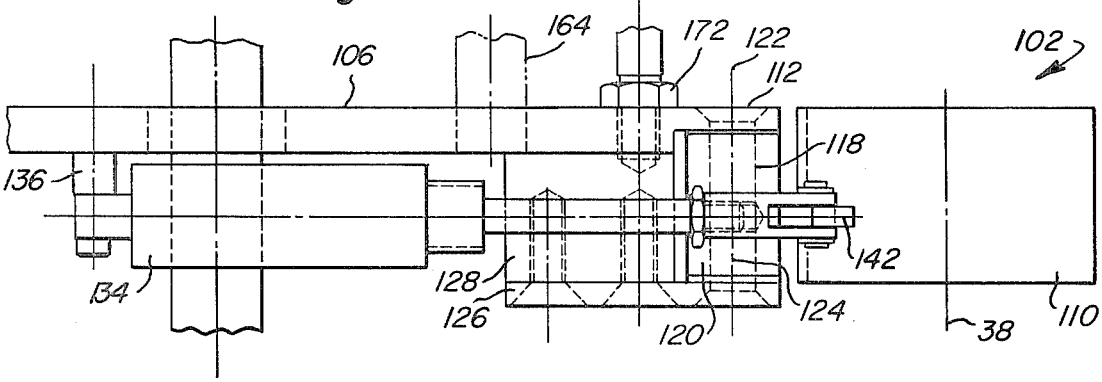
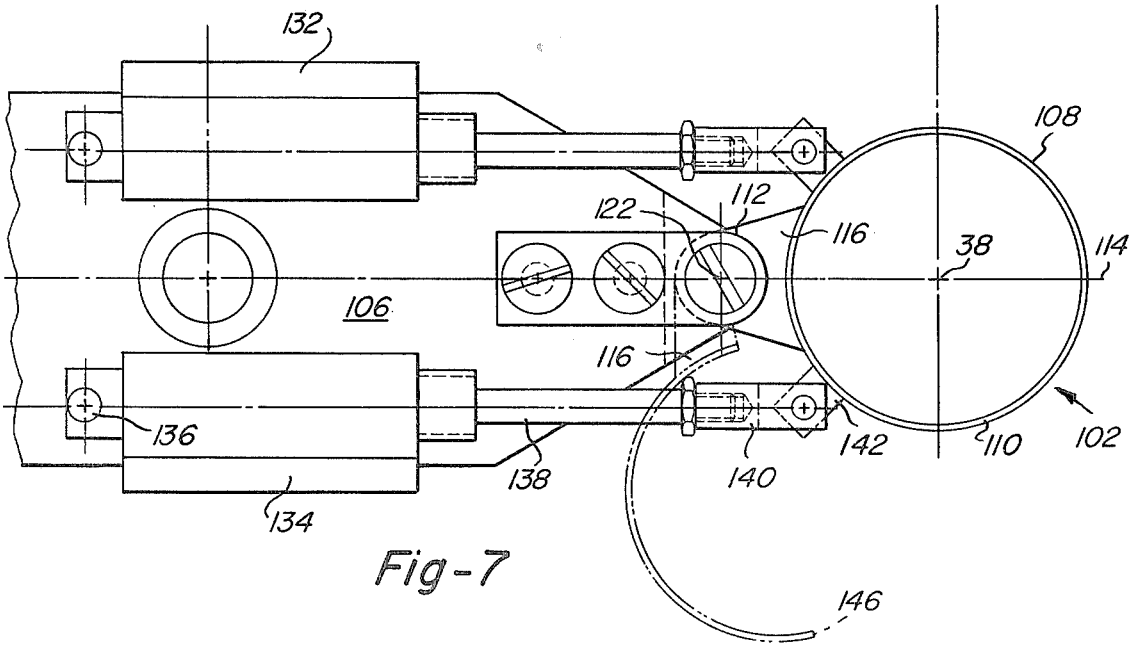
Fig-7

APPARATUS FOR REMOVING BAGS FROM STACKED CAN ENDS

BACKGROUND OF THE INVENTION

The present invention relates to automated article handling equipment and more particularly to the unwrapping of bagged container ends.

In the manufacture of containers such as aluminum soft drink and beer cans, the tops, or ends, of the cans are manufactured in a stamping and scoring operation in a conversion press, where they are provided with beaded rims, "pop-tops", and so forth. The generally flat disc ends are then stacked face-to-face and packaged with paper bags. The bags facilitate transport and handling of the ends and protect them from dirt and other contaminants. The bags are fabricated from a one piece sheet of light weight paper material by joining opposite sides of the sheet to form an elongated tube large enough to enclose the stack of can ends. The bottom of the sheet is folded to form a flap extending radially outwardly from the stack and the top of the wrapper is folded to form a pair of ears extending longitudinally upwardly and radially outwardly from the stack.

The wrapped end packages are transported to a seamer apparatus where the ends are joined to filled beverage cans. At the seamer, the ends must be removed from the wrapper while their stacked configuration is maintained for convenient feeding to the seamer apparatus. The "debagging" of the can ends at the seamer apparatus is commonly carried out by hand and, due to the production speed of the automated seamer, represents a slow-down in the production process.

Attempts have been made in the past to automate the debagging process. Zenger et al., in U.S. Pat. No. 3,686,820 describe a system wherein stacks of ends are encased between heat sealable sheets and transported as a strip of stacked ends. The stacks are removed from the strip by the splitting and unwrapping of the two sheets. Another type of debagging system is described by Bofinger et al. in U.S. Pat. No. 3,441,156. Paper covered packages are carried upward by a conveying mechanism and slit longitudinally by an adjustable knife blade. The slit wrapper is then removed by a pair of opposed rollers.

SUMMARY OF THE INVENTION

The present invention provides a debagging apparatus in which the articles are subjected to a minimum of handling. The wrapped articles are laterally received in a receiving means; the wrapped articles are longitudinally positioned so that an end of the wrapper is clamped by a clamping means; rod means penetrate the wrapper and engage the articles therein; and transporting means transport the clamping means and the wrapper clamped therein relative to the rod means to separate the wrapper from the articles in the receiving means. The preferred structure includes a receiving means comprising a spring loaded, or longitudinally pivotal resiliently deflectable, pair of angled members extending substantially the length of the package; positioning means comprising a piston means for longitudinal movement of the package partially through the receiving means; clamping means comprising cylinder actuated opposing circumferential clamps and a plate means longitudinally engagable with the clamps; and a transporting means comprising a drive shaft and a linear actuator for longitudinal movement of the clamping means to withdraw the wrapper from the articles.

A control system interacts with the foregoing structure to properly sequence and control each operation. The control system actuates a first positioning cylinder and a lower wrapper restraining bail when a package is in the receiving means. The first positioning cylinder extends to move the package through the receiving means to the clamping means. The position of the package and relative to the clamping means is determined through the use of a rod means riding on the package during positioning. The clamping means are then actuated in response to the position of the package. Actuation of the clamping means retracts the first positioning cylinder, extends a rod means cylinder to engage the articles in the wrapper, and initiates the transporting means. The transporting means is further controlled by position sensing switches associated with the rod means.

The present apparatus preferably comprises an apparatus for feeding packages to the receiving means comprising generally semicylindrical elongated article carrying members which move past the receiving means and are indexed with the receiving means and controlled in response thereto. The carrying members are positioned oppositely of the receiving means and the packages and unwrapped articles are transferred into and out of the receiving means by the sliding actions of opposed push bars.

BRIEF DESCRIPTION OF THE DRAWINGS

FIG. 7 is a plan view of a clamping sub-assembly;

FIG. 8 is a side elevational view corresponding to FIG. 7;

DESCRIPTION OF THE PREFERRED EMBODIMENT

Figure 1:
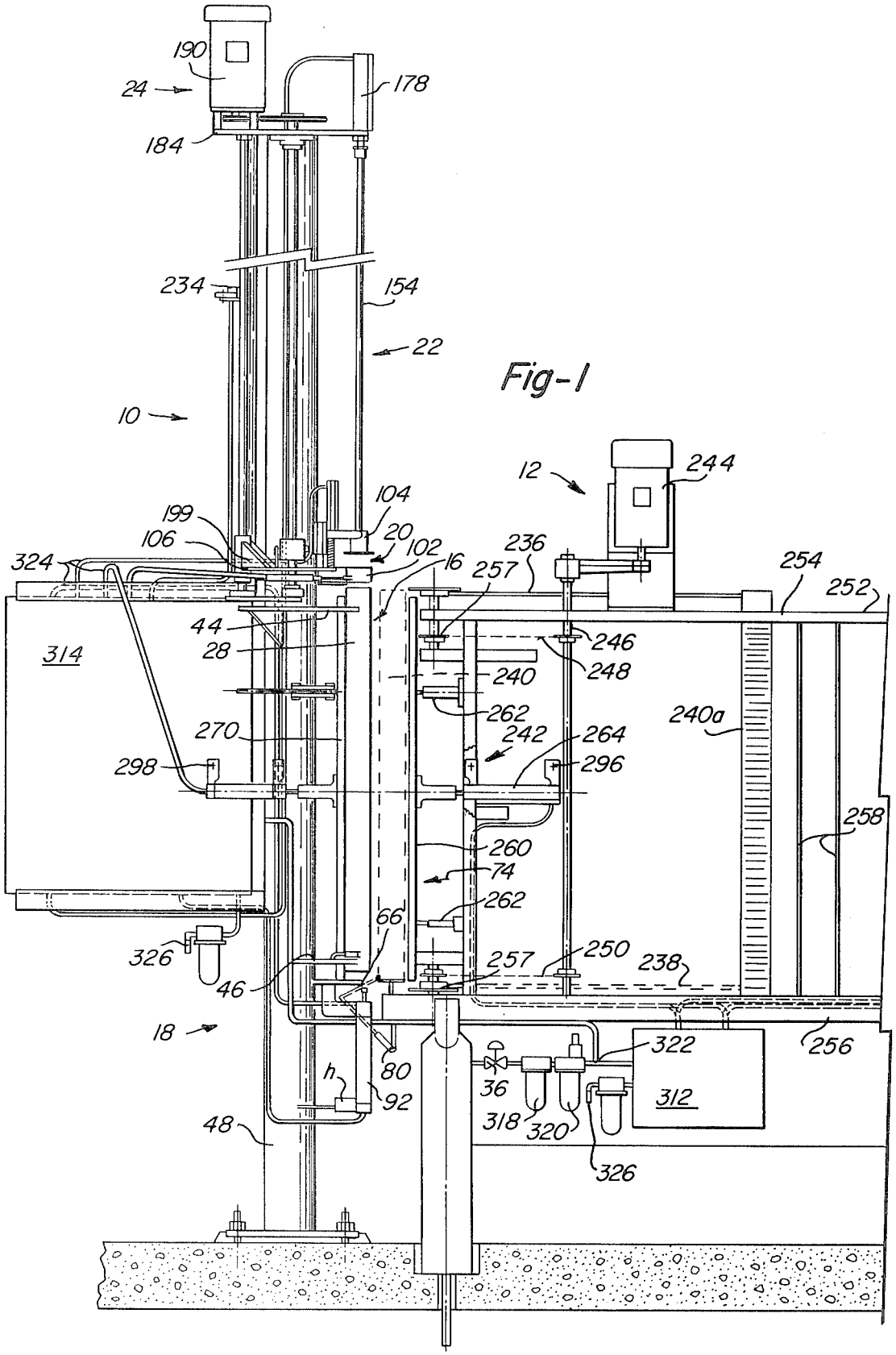
FIG. 1 is a side elevational view of the apparatus of the present invention.
Figure 1A:
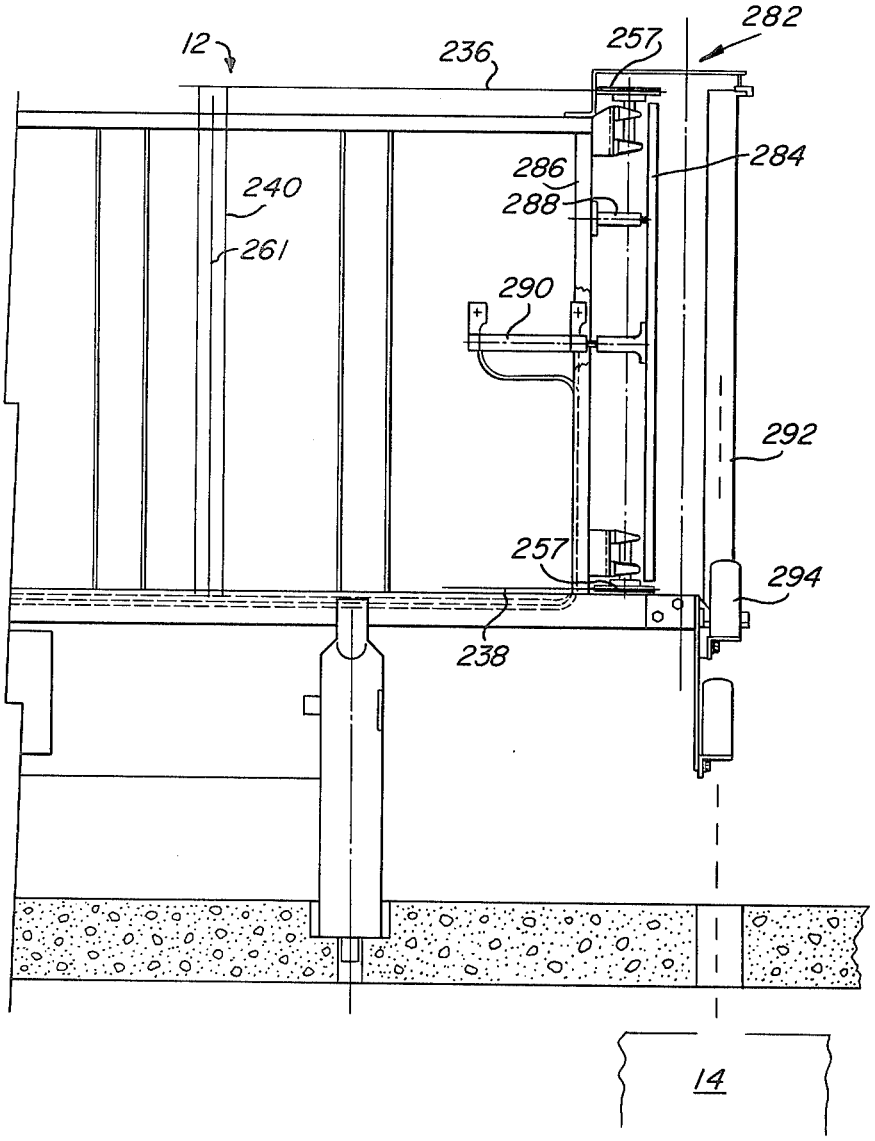
FIG. 1*a* is a continuation of FIG. 1.

Referring to FIGS. 1 and 1*a*, the present debagging apparatus 10 is shown mounted in combination with an automatic package feeder apparatus 12 constructed from a ROTOFEEDER manufactured by Fleetwood Systems, Countryside, Ill., and a conventional apparatus for handling unwrapped articles such as a can end seamer 14. The ends are arranged in the package feeder in a cylindrical package wrapped in paper and having a longitudinal and lateral axis. The packages are transferred into a receiving means through lateral movement. The unwrapped articles are transferred through lateral movement from the receiving means to the feeding means for further transport. The debagger apparatus comprises generally a receiving means 16, for laterally receiving bagged, stacked ends from the feeder apparatus 12; positioning means 18 at a first, or lower, end of the package for positioning the wrapper at a second, or top, end at a clamping means; a clamping means 20 at the second end of the wrapper for holding the wrapper during debagging; rod means 22 for penetrating the wrapper and engaging the articles therein to hold them relative to the clamping means; and transporting means 24 for longitudinally transporting the clamping means, with the wrapper end in the clamping means, relative to the rod means, thus causing separation of the wrapper from the articles in the receiving means and displacing the wrapper for further handling.

RECEIVING MEANS

Figure 5:
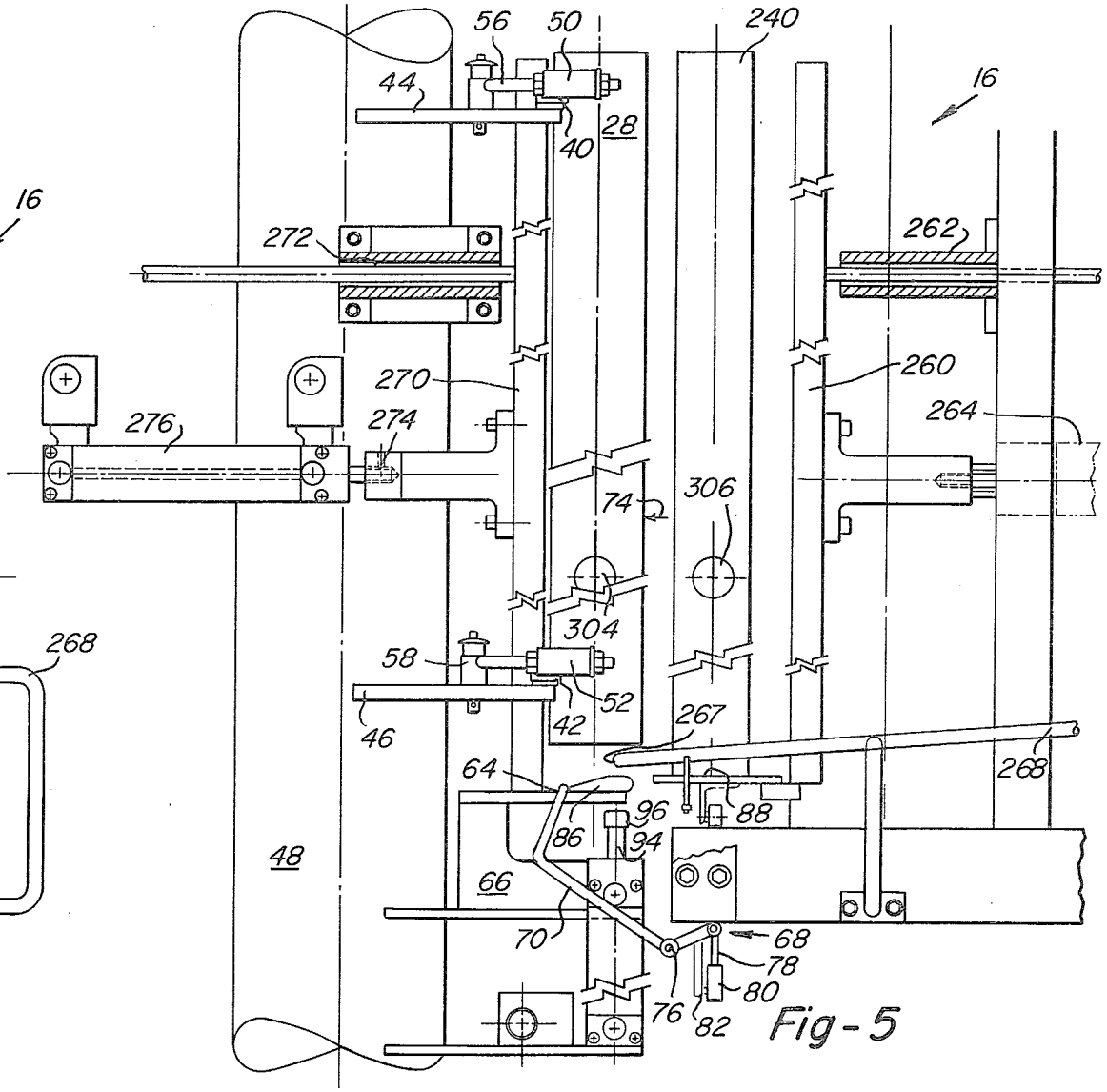
FIG. 5 is a side elevational view corresponding to FIG. 4.
Figure 6:
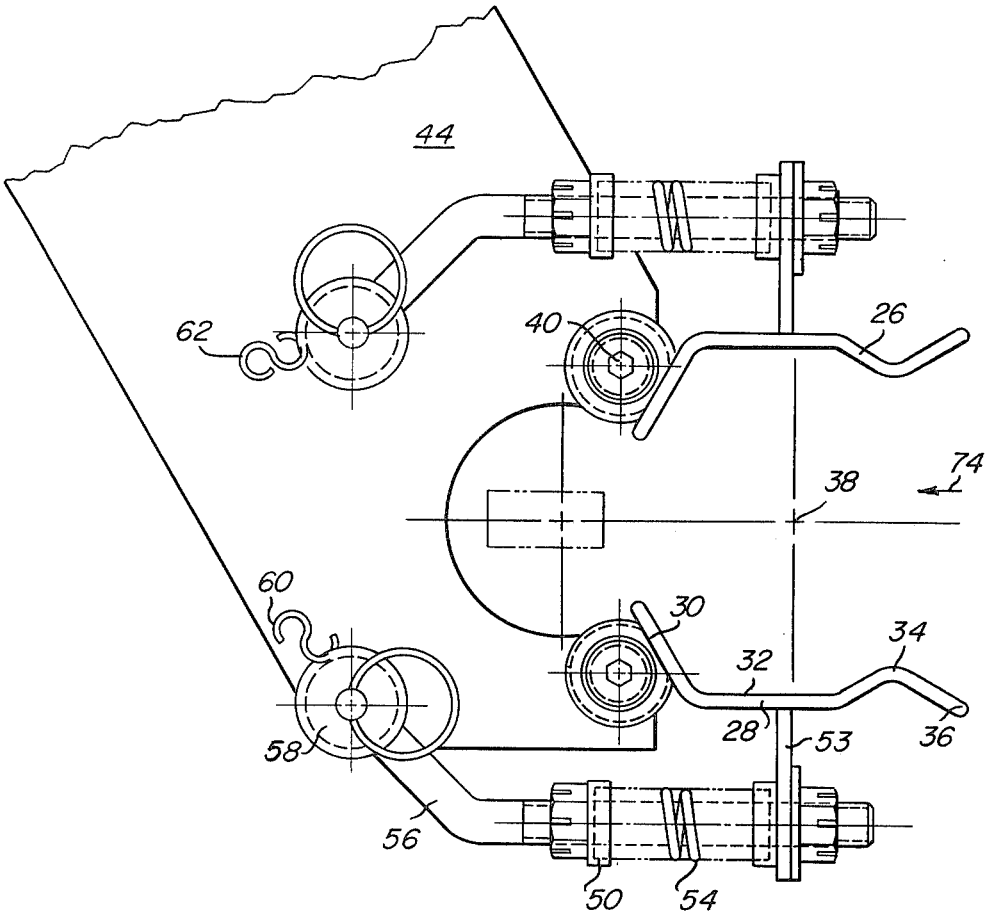
FIG. 6 is a plan view of a receiving sub-assembly.
Figure 10:
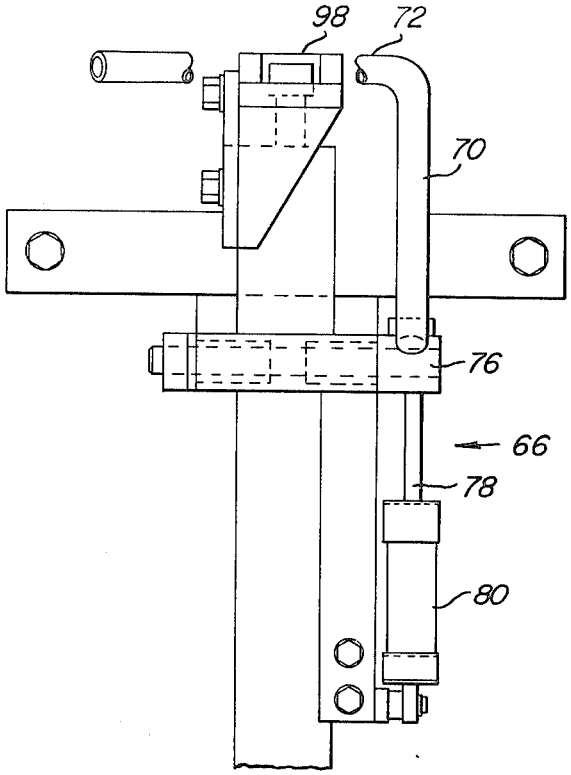
FIG. 10 is a front view corresponding to FIG. 9.

The receiving means 16, as shown in FIGS. 1, 4, 5, and 6, comprise a pair of opposing outwardly flanged, angled members 26, 28 extending substantially the length of the wrapper and the articles therein. Each member is angled to form sections comprising, from inwardmost to outwardmost, a planar, rearmost inwardly angled portion 30 (FIG. 6), a laterally extending portion 32, an inwardly curved lip portion 34, and an outwardly curved flange portion 36. The members 26, 28 thereby provide a package receiving pocket of uniform longitudinal cross section around a vertical receiving pocket center line 38. Each member 26, 28 is longitudinally pivotal and supported on an upper and a lower hinge 40, 42 mounted through mounting plates 44, 46 to the inwardly angled portion 30 of the member. The mounting plates are secured to a vertically extending main apparatus support 48. The members 28, 30 are made resiliently deflectable to retain therebetween the packages and the unwrapped articles by an upper and lower pair of opposed spring assemblies 50, 52. The spring assemblies are mounted in axial displacement from the central portion 30 of each member through a bracket 53 extending normally outwardly from the central portion. The spring assemblies further comprise a compression spring 54 extending from the bracket 53 to a centrally inwardly angled pivot arm 56 pivotally mounted through a bearing unit 58 to a hinge and spring mounting plate 44, 46 connected to the main apparatus support 48. As shown in FIG. 6 the bearing units comprise ball lock pins 60, 62 to permit wider service access to the receiving pocket by spreading the elongated members 26, 28. The compression springs are adjusted to position the elongated members 26, 28 with their central portions parallel to the direction of package feed as indicated by arrow 74 and spaced apart a distance approximating the diameter of the package to be received. Lateral movement of a cylindrical package will thus cause the members to spread through entry or exit force and return through compression spring force to rest position with an entering package laterally supported by, but longitudinally freely movable within, the receiving pocket.

POSITIONING MEANS

The positioning means 18, as shown in FIGS. 1, 4, 5, 9, and 10, longitudinally orient the package and the unwrapped articles in the apparatus. The positioning means comprise a horizontal, planar support surface 64 comprised in the upper surface of a plate and bracket member 66 extending outwardly from the main apparatus support 48 beneath the receiving means. A wrapper restraining bail 68 is mounted to pivot against the support surface 64 below a laterally inward portion of the receiving means. The wrapper restraining bail 68 comprises an angled rod member 70 terminating upwardly in a linear portion 72 extending parallel to the support surface 64, just above the support surface, and transverse to the direction of package feed as indicated by arrow 74 (FIG. 5). From the upper linear portion 72, the angled rod member 70 is curved downwardly and curved again outwardly, oppositely of the direction of arrow 74, to a fixed pivot bearing 76. From pivot 76 the angled rod member extends upwardly and outwardly to a cylinder rod 78, to which the rod member is pivotally attached. The cylinder rod 78 operatively extends from a restraining clamp cylinder 80 fixedly mounted to a plate 82 extending from the feeding means discussed below. The cylinder 80 is a reciprocating, fast acting, double acting pneumatic cylinder, as are all other cylinders referred to in the present specification unless otherwise noted. The angled rod member 70 is arranged to securely engage the support surface 64 upon extension of cylinder rod 78. The lower wrapper restraining bail thus restrains the bottom flap of a wrapper resting in the receiving pocket between the support surface 64 and the angled rod member 70.

Figure 9:
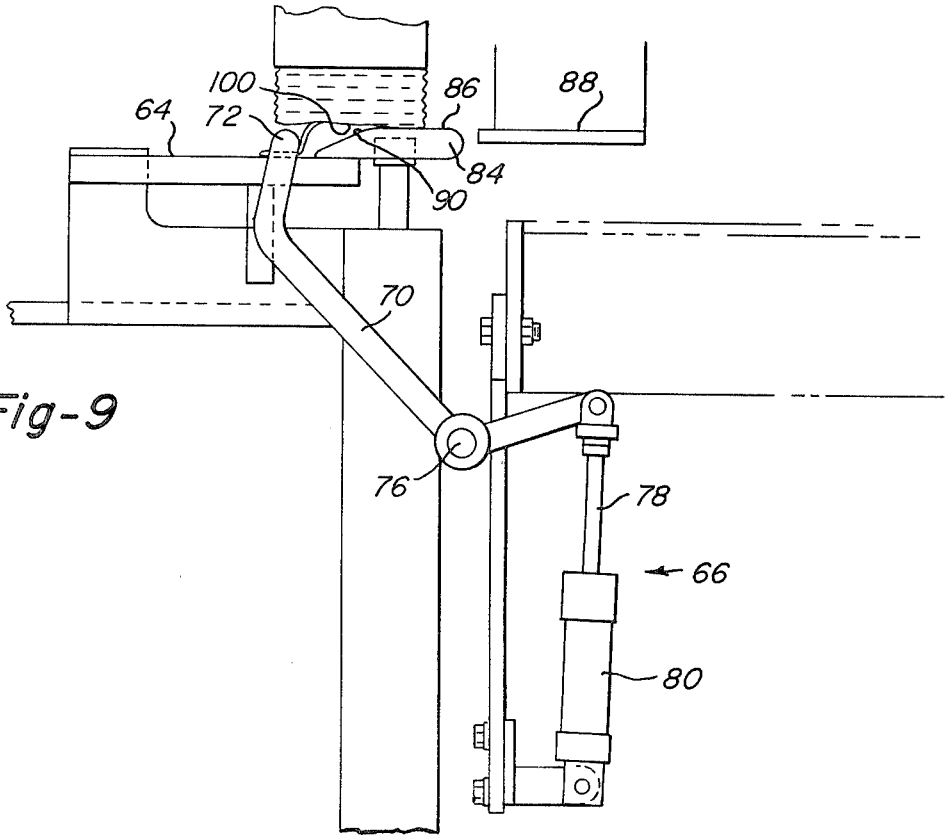
FIG. 9 is a side elevational view of a wrapper restraining subassembly.

As shown in FIG. 9, the support surface, apart from supporting the package also guides the bottom flap into and under the restraining clamp by an outward foot portion 84. The upper surface 86 of the outward foot portion is parallel to and longitudinally upwardly displaced from the main support surface 64. The upper surface 86 is aligned with the support surface 88 of the feeder means. The foot portion terminates laterally inwardly in an inwardly downwardly linearly tapered portion 90 extending to the main support surface 64. The bottom flap of the entering package is thus guided along the upper support surface 86, down the tapered portion 90, along the main support surface 64, and under the raised tubular member.

A positioning cylinder 92 longitudinally moves the wrapped articles upwardly from the support surface 64, 86 along an axis parallel to the central longitudinal axis 38 of the receiving pocket. The positioning cylinder 92 is vertically mounted to the plate and bracket member 66. The rod 94 extending from the positioning cylinder 92 terminates in a broadly flattened tip 96 for supporting the package during extension of the rod 94. During extension, the tip 96 passes through an aperture 98 in the foot portion 84 of the support surface and engages a laterally outward portion of the bottom surface 100 of a package contained in the receiving means to move the package along the central axis 38 within the receiving means to a proper position with regard to the clamping means.

CLAMPING MEANS

Referring now to FIGS. 1, 2, 3, 7 and 8, the clamping means 20 comprises a first clamp 102 for circumferentially surrounding an end portion of the wrapper, a second clamp 104 for engaging an upper end portion of the wrapper between the second clamp and the first clamp, and a longitudinally movable platform 106 on which the first and second clamps are mounted.

The first clamp 102 comprises a pair of opposed semicylindrical clamping members 108, 110 centered about and extending longitudinally parallel to the receiving means center line 38. The clamping members open and close through arcuate hinged movement about a common central split hinge 112. The hinge 112 is located along a central lateral line 114 extending through the center of the receiving pocket, the center of the cylinder formed by the clamping members 108, 110, and parallel to the rearward direction of feeding movement indicated by arrow 74. The hinge 112 is rearward of the clamping members 108, 110. Each clamping member is attached to the hinge 112 by a short, tapered swing arm portion 116 extending inwardly from a rearward, central edge portion of the member and terminating in an annular sleeve portion 118, 120 which is above the swing arm portion 116 of one clamping member and below the swing arm portion of the other member, so that both sleeve portions have a common central longitudinal axis 122 parallel to the central axis 38 of the clamping means and on the central lateral line 114. A pin 124 extends along the common central axis 122, through the sleeve portions from the platform 106 to a hinge support member 126 mounted through a spacer block 128 on the lower side, facing the receiver means, of the platform. The upper and lower surfaces of the clamping members 108, 110 are approximately coplanar with the upper surface of the platform 106 and the lower surface of the support member 126, respectively. The upper edge surfaces 128, 130 of the clamping members define, in the closed position, a circle normal to the central axis 38 and bounded by the smooth parallel inner and outer surfaces of the clamping members. The upper edge surfaces 128, 130 form a second clamp abutment surface.

The clamping members 108, 110 are pivotally opened and closed by a pair of clamping member cylinders 132, 134. Each cylinder is rearwardly secured to a pin 136 extending downwardly from the lower side of the platform 106. A cylinder rod 138 extends forwardly outwardly from each cylinder and is threadably adjustably received in a cylinder rod attachment member 140 pivotally attached to a tab portion 142 extending radially outwardly from the clamping member 108, 110 at a rearward angle to the central lateral line 114. The clamping member cylinders 132, 134 are thus arranged to extend and retract along lines parallel to the central lateral line 114 to close and open, respectively, the clamping members 108, 110 between a closed position in which the members are in opposing abutment to form a circumferentially continuous clamp and an open position in which the forward edge abutting surfaces 144, 146 of the members are widely spread, outwardly and rearwardly of the receiving pocket and thereby freely permit disassociation of the removed wrapper from the clamping means.

The second clamp 104 comprises longitudinally movable plate means 148 (FIG. 2) of generally circular cross section, of a diameter slightly larger than the diameter of the two closed clamping members 108, 110, and having a planar lower surface for engagement with the upper clamping member surfaces 128, 130. The plate means 148 is centered on the receiving pocket center line 38 and is fixed to a cylindrical support member 150 having a diameter approximately two thirds that of the plate means and having a planar lower abutment surface for firmly supporting the plate means. The support member 150 and plate means 148 bear therethrough a cylindrical bore 152 containing a bushing for freely slidably receiving a rod member 154 acting as part of the rod means described below. An apertured cover plate 156 is mounted across the upper surface of the support member 150 to protect the bushing and guide the rod member 154 through the support member bore 152. The support member 150 is mounted on a forked, reciprocating support arm 158 having forks extending oppositely parallel to the lateral central line 114 and pivotally attached through pins 159 to radially opposite sides of the support member. The forked arm 158 extends inwardly to a bearing sleeve portion 160, parallel to the receiver pocket axis 38. The bearing sleeve portion 160 contains a cylindrical aperture 162 for freely slidably receiving therethrough a clamp guide shaft 164 extending upwardly from a central outward portion of the platform 106. The second clamp 104 is actuated by a singly acting second clamp cylinder 166 having a rod end cylinder surface 168 facing downwardly and abutting an upper surface of the forked arm 158. A cylinder rod 170 operatively extends from the second clamp cylinder 166 freely through the forked arm 158 to a threadably adjustable mounting nut 172 which secures the cylinder rod to the platform 106. A compression spring 174 is axially fitted around the cylinder rod 170 between the forked arm 158 and the platform 106. The upper end of the cylinder is fixed on upper end of the cylinder rod 170. Thus the single action cylinder is activated to retract the cylinder arm which in turn forces the cylinder and the plate means 148 operatively associated therewith down on the clamp guide shaft 164 towards the platform 106. The mounting nut 172 is adjusted to provide secure engagement during retraction between the plate means 148 and the second clamp abutment surface of the clamping members 108, 110.

ROD MEANS

Figure 2:
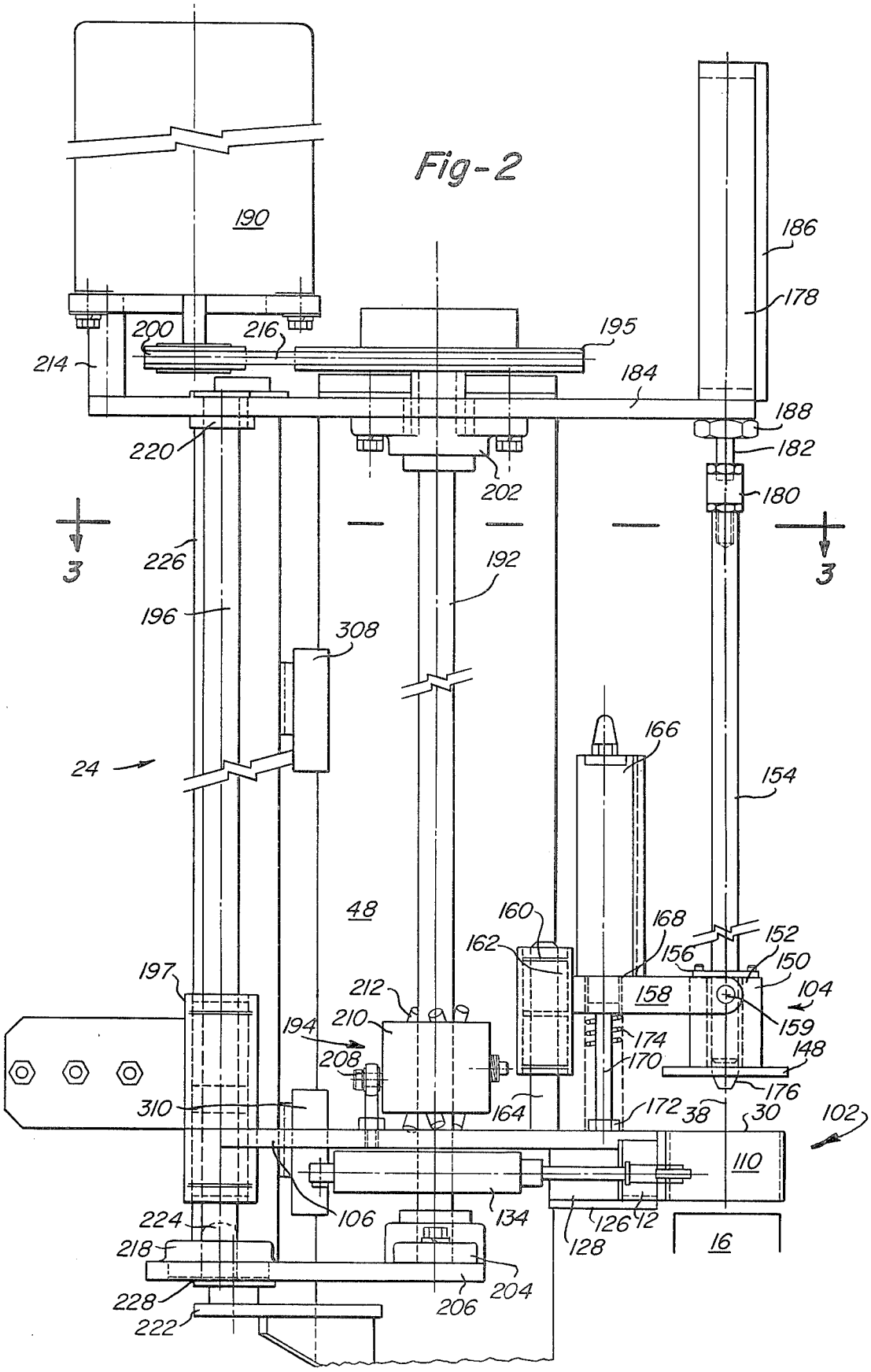
FIG. 2 is a side elevational view of an upper clamping and transporting sub-assembly.

Referring now to FIGS. 1 and 2, the rod means 22 comprises a rod member 154 having a generally conical tip 176 and an end connected to a rod means cylinder 178. The rod member 154 extends and reciprocates along the receiving pocket axis 38 through the second clamp as described above. It terminates downwardly in a generally conical tip 176 which is gradually tapered and has a bluntly rounded bottom for penetrating a wrapper and engaging the articles therein. The rod member 154 terminates upwardly in a threaded connecting member 180 threadably adjustably attached to a short rod means cylinder rod 182 extending from the rod means cylinder 178. The rod means cylinder 178 is secured to a longitudinally fixed, laterally pivotal upper plate member 184 by a side bar member 186 mounted to the side of the cylinder perpendicularly to the upper plate member and by an adjustment nut 188 surrounding the cylinder rod shaft 182 to force the cylinder 178 against the plate member. The rod means may be fully extended to position the rod tip 176 downward of the clamping members 108, 110 to the top of a package resting on the support surface 64, partially fixably extended to lie approximately within the clamping members 108, 110 to engage and retain articles therein, and retracted to a position within the second clamp 104.

TRANSPORTING MEANS

Figure 3:
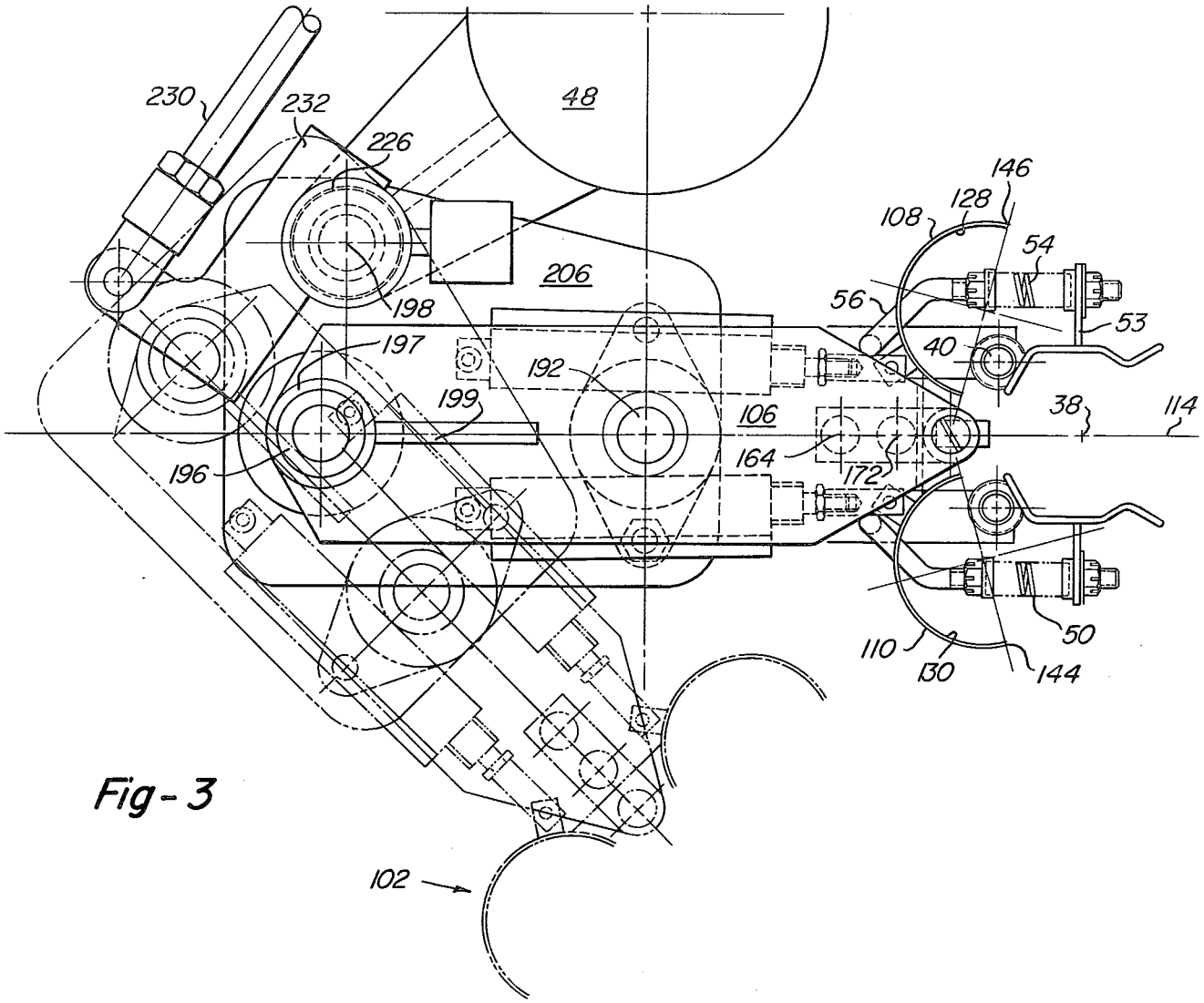
FIG. 3 is a plan section view, taken along line 3–3' of FIG. 2, of a clamping and transporting sub-assembly.

Referring now to FIGS. 1, 2, and 3, the transporting means 24 comprises the longitudinally fixed, laterally pivotally mounted upper plate member 184 serving to support the rod means and a motor means 190 for rotating a drive shaft 192 extending to and through the platform 106, a linear actuator 194 associated with the drive shaft, a guide shaft 196 for guiding the longitudinal movement of the platform, and a pivotal axis 198 about which the platform and upper plate member may laterally rotate. The shafts and axis extend parallel to the central receiving pocket axis 38. The upper plate member 184 is supported longitudinally above the platform 106 at a distance at least equal to the length of the wrapper to be separated. The upper plate member is supported by the drive and guide shafts and the pivot assembly.

The drive shaft 192 bears at its uppermost end a relatively large diameter pulley wheel 195 rotatably mounted above the upper plate member 184 and driven in an approximate 3:1 ratio by a belt from a smaller pulley wheel 200 from the motor means 190. The drive shaft 192 extends freely rotatably through the upper plate member, where it is surrounded by a mounting and bearing housing 202, through the platform 106 to a receiving socket 204 mounted on a longitudinally fixed, pivotal lower shaft plate 206 extending parallel to the central lateral axis 114 a short distance below the platform 106. A linear actuator 194 is circumferentially mounted around the drive shaft 192 and fixed to the platform 106 through a mounting bracket 208 extending downwardly from the linear actuator. The preferred linear actuator comprises a ROHLIX brand actuator having a cylindrical housing 210 and off-center cams 212 mounted at an angle to the drive shaft and riding on the drive shaft so that rotation of the drive shaft causes upward or downward movement of the actuator. Rotation of the drive shaft is controlled by an electric motor 190 mounted shaft downward to a laterally innermost portion of the upper plate member 184 and spaced thereabove by a short mounting arm 214. The small pulley wheel 200 is mounted on the motor shaft and is connected by a pulley belt 216 to the large pulley wheel 194 fixed on the upper end of the drive shaft 192 above the upper plate member.

The lower shaft plate 206 rotatably receives and partially supports the drive shaft 192. The guide shaft 196 also is pivotally and supportively received in a laterally inward socket portion 218 of the lower shaft plate 206. The guide shaft 196 extends upwardly to a laterally inward portion of the upper plate member 184 just outwardly spaced of the shaft of the motor 190, where the guide shaft 196 is rotatably received by an upper socket portion 220 facing downwardly from the upper plate member. The guide shaft 196 also extends through a longitudinally extending cylindrical bearing sleeve portion 197 of the platform 106. The bearing sleeve portion 197 is secured to the platform 106 through an outwardly tapered, upwardly extending brace plate 199. As shown in FIG. 3, the guide shaft 196 and drive shaft 192 are on the central lateral axis 114 of the device. The guide shaft 196 serves to guide the platform 106 and associated structure up the drive shaft 198 and also to prevent pivotal rotation of the platform 106, upper plate 184, and lower plate 206 resulting from torque from the motor 190 as the motor turns the drive shaft 198 to raise and lower the platform 106 and the clamping means associated therewith.

The lower shaft plate 206 receives therethrough a lower pivot assembly constructed around the pivotal axis 198. The assembly comprises a pivot support brace 222 fixedly mounted on the main apparatus support 48. The brace 222 comprises a pivot bearing pin 224 extending upwardly therefrom. An open ended cylindrical pivot tube 226 is rotatably fitted over the pin and extends upwardly to a similar pin extending downwardly from a laterally inward portion 226 of the upper plate member 184. The pivot tube is transversely offset from the guide shaft and the platform 106. The brace 222 further comprises a bearing surface 228 on which the lower plate 206 is pivotally supported.

As shown in FIG. 3, the upper plate member 184, lower plate 206, and platform 106 are laterally rotatably axially displaced about pivot axis 198 through the action of a platform rotating cylinder rod 230 pivotally connected to a rotatable rectangular carriage plate 232 laterally parallel to the center line 114 and fixedly mounted to the pivot tube 226. A pivotal cylinder 234 (FIG. 1) is secured to the main apparatus support 48 at a position longitudinally intermediate of the platform 106 and the upper plate member 184. Extension of the pivotal cylinder 234 thus rotates the pivot tube 226 to rotate the platform 106 through approximately 45° of arc and to laterally inwardly displace the clamping means at the laterally outward portion of the platform 106 due to the transversely offset pivot axis 198.

FEEDING AND EJECTING MEANS

The foregoing apparatus, wherein the receiving means is fixed in a longitudinally upright position, is particularly constructed for feeding and ejecting means which laterally transport incoming packages and outgoing unwrapped articles in an upright position and which feed and eject along a common lateral axis 114.

Figure 4:
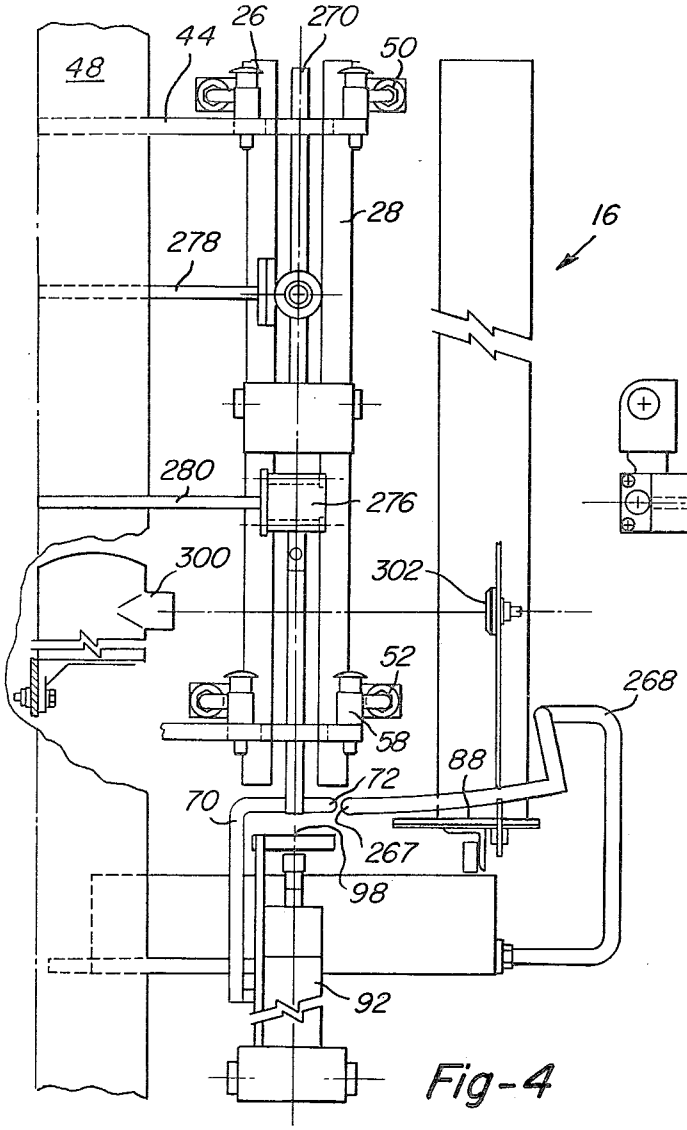
FIG. 4 is a rear view of a lower receiving sub-assembly.

Referring now to FIGS. 1 and 1*a*, the preferred feeding means 12 comprises a pair of axially spaced upper and lower driven endless chain belts 236, 238, a plurality of upright, generally semicylindrical article carrying members as indicated at 240 extending between and movable by the belts, and a first push means 242 for laterally pushing the wrapped articles into the receiving means 16. The upper and lower endless chain belts 236, 238 are driven by a feeding means motor 244 which drives a shaft 246 extending between the two belts, which are driven by sprockets 247 connected to secondary belts 248, 250 from the shaft. The belts and motor are supported by a feeder frame 252 comprising an upper brace 254 and a lower channel member 256 which support a number of belt sprockets 257. The frame 252 comprises vertical struts 258 extending between the parallel upper brace 254 and lower channel member 256. The channel member 256 guides and supports the carrying members 240 as they are driven by the endless chain belts 248, 250 around the feeder in an endless loop counterclockwise, or from left to right in the view of FIG. 1. The first push means 242 comprises a thin, upright bar member 260 supported on upper and lower ball bushing guides 262 and laterally reciprocably operable along the central lateral line 114 by a feeding cylinder 264 which is laterally inwardly facing and mounted at a longitudinally midway position on the feeder frame 252. The bar member 260 is relatively thin and extends substantially the entire length of the carrying members and operates by passing through a slot 261 in the rear of each carrying member and extending into the carrying member. The carrying members 240 are constructed to be laterally alignable with the receiving pocket. As shown in FIGS. 4 and 5, the bottom support surface 88 of a carrier member is essentially coplanar with the outer foot portion 86 of the receiving means. A bottom flap guide bar 268 is angled inwardly downwardly along a transversely offset portion of the foot portion to guide the wrapper bottom flap onto the support surface 64. The inward end 267 of the flap guide is aligned with the restraining clamp rod 72 when the latter is in the upper position.

The feeding means motor 244 is stopped when a carrying member 240 is directly opposite the receiving pocket defined by the angled members 26, 28. Assuming a package in the carrying member 240 and an empty receiving pocket, the feeding cylinder 264 extends to push the bar member 260 through the carrying member thereby transfering the package onto the receiving slot. After the package is unwrapped, the articles are ejected by ejecting means from the receiving slot onto an empty carrying member.

The ejecting means comprise an elongated thin bar member 270 similar to the ejecting bar member 260 and extending substantially the length of the receiving members 26, 28. The bar is positioned inwardly of the receiving members 26, 28 and operates between the receiving member hinges and springs. The bar member 270 is slidably mounted on upper and lower ball bushings 272 for reciprocal movement along the pocket center line 114. The bar member is connected through a mounting hub 274 to the rod of an ejecting means cylinder 276. The ball bushings 272 and cylinder 276 are mounted to the main apparatus support 48 by mounting plates 278, 280.

Ejecting cylinder 278 thus extends to slide the articles from the receiving pocket along the receiving means support surface 86 onto the bottom surface 88 of a carrying member 240.

The carrying members travel around the periphery of the feeder to transport packages from a loading station to the debagging apparatus and to concurrently transport unwrapped articles, as shown at 240*a*, to an apparatus 14 for further handling. As shown in FIG. 1*a*, articles are delivered to this apparatus through an article ejection assembly 282 at an end of the feeder opposite to the debagging apparatus. The ejection assembly comprises a push bar 284 mounted to a frame strut 286 through a ball bushing 288 and operated by an article ejection cylinder 290 in an manner similar to the feeding and ejecting means described above. The ejected articles enter a chute 292 through which they fall to the article apparatus 14.

CONTROL MEANS AND OPERATION

The present apparatus is provided with control means to make its operation essentially automatic.

The feeder 12, driven by motor 244 is indexed to the article ejecting means 282 and to the package ejecting means. The motor is activated in response to a demand photocell 294 which is triggered when the apparatus 14 is to receive more articles. The photocell 294 extends the article ejection cylinder 290 to supply more articles to the article apparatus 14 and, upon retraction of the cylinder, advances the next article carrying member. Upon activation of motor 244, the indexing of a carrying member 240 with the receiving means 16 is controlled by a mere switch triggered by a pin on each carrying member. A first control means controls the ejecting means 270 and feeding means 12 in response to the presence or absence of articles in the indexed receiving means or in a feeding means carrier member opposite the receiving means. The control means comprises a limit switch (a) 296 for sensing the retracted position of the feeding cylinder 264, a limit switch (b) 298 for sensing the retracted position of the ejecting cylinder 276, a first photocell 300 and an associated reflector 302 (FIGS. 4 and 5) looking through an opposed pair of apertures 304 in the receiving members 26, 28 to sense the presence of articles therein, and a similar photocell arrangement (not shown) looking through apertures 306 in the carrying member 240 for the presence of articles therein. If both cylinders are retracted, the carrying member 240 contains an object and the receiving means 12 does not, the feeding cylinder 264 will extend to feed the apparatus. Similarly, if both cylinders are retracted, an object is in the receiving means, and the carrying member 240 opposite the receiving means is empty, the ejecting cylinder 276 will extend to empty the receiving means. The photocells may indicate articles in both the receiving means 16 and in the next adjacent carrier member because the feeder 12 has advanced a carrying member to supply the article handling apparatus 14. In this case, neither the feeding nor the ejecting cylinder will be actuated.

Upon extension and retraction of the feeding cylinder 264 and given retraction of ejecting cylinder 276, indicating the presence of wrapped articles in the receiving means, an unwrapping control sequence comprising positioning, clamping, and transporting is initiated as the restraining clamp cylinder 80 extends to restrain the wrapper flap on the support surface and rod means cylinder 178 extends until the rod tip 176 engages the top of the wrapper. A limit switch (c) on the restraining clamp cylinder 80 begins slow extension of the positioning cylinder 92, thereby raising the package and the rod member 154 associated with the rod means cylinder 178. A limit switch (d) on the rod means cylinder is tripped when the rod tip indicates that the package is just above the upper surfaces 128, 130 of the clamping means. Limit switch (d) admits air to both sides of the positioning cylinder 92 to hold the package in place. The raising of the package has caused the bag flap to be pulled down or loosened by the restraining bail associated with the cylinder 80. The limit switch (d) extends the clamping member cylinders 132, 134 to clamp the upper portion of the package with a portion of the wrapper extending above the clamping members 108, 110. An extension limit switch (e) on the clamping member cylinder 132 retracts the second clamp cylinder 166 to trap an upper portion of the wrapper, including the "ears" of the wrapper, between the clamps. A limit switch (f) on the second clamp cylinder 166 retracts the positioning cylinder 92. Retraction of this cylinder 92 trips a limit switch (g) which causes a short burst of air to be delivered to the rod means cylinder 178, extending the cylinder and causing the tip of the rod 154 to penetrate the wrapper and engage the top of the stacked wrapped articles. Approximately two seconds after limit switch (g) is activated, the drive motor 190 is started to raise the platform 106 and the clamping means and the wrapper associated therewith. The clamping means is raised along the drive shaft 192 and guide shaft 196, separating the wrapper from the articles therein, until the platform 106 reaches an upper magnetic proximity switch 308 (FIG. 2). The upper proximity switch 308 retracts the rod means cylinder 178. After retraction of the rod means cylinder, the first control sequence is repeated with limit switches (a) and (b) and the photocells looking for an empty carrier member to cause the unwrapped articles to be ejected into the first available carrier member. Ejection occurs through extension of the ejection cylinder 276, which is immediately retracted. Retraction of this cylinder 276 activates a limit switch (h) to retract the pivotal cylinder 234 to axially displace the wrapper clamped by the clamping means on the platform 106. At the same time, the second clamp cylinder 166 is de-energized and spring returned and the clamping member cylinders 132, 134 are retracted to free the wrapper. Limit switches (i, j) on the clamping means cylinder 134, 166 indicate unclamping and activate drive motor 190 to lower the platform 106 and strip the wrapper from the rod. The platform is lowered until a lower magnetic proximity switch 310 indicates that the platform has returned to its initial level, at which time the pivotal cylinder 234 is extended to return the clamping assembly to its original position and a receiving sequence is initiated. The limit switches used in the present apparatus may be selected from any type of switch capable of opening and closing a solenoid-controlled air line valve in response to cylinder piston position. Suitable limit switches include magnetic reed switches responsive to a magnetic band on the cylinder piston and mechanical pin switches activated by physical displacement of the pin by the piston. A reed switch is presently preferred for limit switch (d) so that, during positioning, undue force is not exerted on the wrapped articles.

The solenoids, air valves and air lines for carrying out the above control sequences are housed in a feeder cabinet 312 for the feeder and article ejecter cylinders 264, 290 and a main cabinet 314 for the remaining cylinders. The main air supply enters through a valve 316, a filter 318, and a lubricator 320 to the feeder cabinet 312 and through a tee connection 322 to the main cabinet 314. Lines 324 lead from the cabinet to opposing ends of the various cylinders. Air is exhausted through filtered, silenced exhausts 326.

The present method and apparatus, as described hereinabove, separates a wrapper from articles wrapped therein with a minimum amount of article and wrapper handling. Furthermore, the apparatus operates substantially from pneumatic or hydraulic cylinders and therefore requires a minimum amount of maintenance and repair. In addition, the present apparatus does not destroy or slit the wrapper as it is removed, permitting recycling of the wrapper by repair of the damaged end of the pieced bag and refolding of the restrained flap. As a further advantage, the present apparatus adapts easily to operations which already make use of a conventional ROTOFEED apparatus and does not require the replacement of existing transporting apparatus. A debagging cycle can be carried out in ten to fifteen seconds.

While the inventive concepts have been disclosed herein with reference to an illustrative and presently preferred embodiment thereof, it is to be understood that many of the inventive concepts may be carried out other than as specifically described. For instance, the apparatus need not operate in a vertical mode, but may be variously angled and adapted to other manufacturing equipment. Instead of the limit switch (d) used to sense the position of the top of the wrapper, an rf proximity switch near the clamping means could be used. Instead of a linear actuator 194 used to raise the clamping means, an air cylinder could be used. The receiving means 16 could be included as part of the carrying member 240. This is advantageous in eliminating the feeding and ejecting cylinders but disadvantageous in tying up the feeding apparatus during the debagging operation. Thus, it is intended that the appended claims be construed to include alternative embodiments except insofar as limited by the prior art.

What is claimed is:

1. An apparatus for separating a wrapper from wrapped articles, said wrapped articles forming a package having a longitudinal dimension, comprising:

receiving means for laterally supportively receiving the wrapped articles and for permitting movement along said longitudinal dimension of received wrapped articles while being so laterally supported;

positioning means at a first end of said wrapper for positioning along said longitudinal dimension a second end of the wrapper at a clamping means;

said clamping means at the second end of said wrapper for holding said wrapper;

rod means for passing through the wrapper and abutting the articles therein; and transporting means for transporting along said longitudinal dimension said clamping means and said wrapper relative to said rod means whereby said wrapper is separated from the articles in the receiving means.

2. The apparatus of claim 1, further comprising:

feeding means for feeding the wrapped articles to the receiving means;

ejecting means for ejecting unwrapped articles to the feeding means; and indexing means for aligning the feeding means and the ejecting means.

3. The apparatus of claim 1, wherein said receiving means comprises:

a pair of opposing, outwardly flanged, angled members extending substantially the length of the wrapped articles therein, said members being longitudinally pivotal to receive the wrapped articles and resiliently deflectable to retain the articles received.

4. The apparatus of claim 1, wherein said positioning means comprises:

a support surface at a first end of said wrapper;

a wrapper restraining clamp pivotable against said support surface for restraining the first end during positioning; and a positioning cylinder for longitudinally moving said wrapped articles from said support surface and relative to said clamping means.

5. The apparatus of claim 4, further comprising:

sensing means for sensing the position of the second end of the wrapper, said sensing means including sensors on said rod means, said rod means riding on said wrapper and articles during positioning.

6. The apparatus of claim 1, wherein said clamping means comprises:

a first clamp comprising a pair of opposed semicylindrical clamping members for circumferentially surrounding said wrapper; and a second clamp comprising a longitudinally movable plate means for engaging a portion of said wrapper between the first clamp and the plate means.

7. The apparatus of claim 1, wherein said rod means comprises:

a rod member having a generally conical end and an end connected to a rod means cylinder for reciprocatively moving said rod member.

8. The apparatus of claim 1, wherein said clamping means are mounted on a longitudinally movable platform operatively connected to said transporting means.

9. The apparatus of claim 8, wherein said transporting means comprises:

a longitudinally fixed, laterally pivotally mounted upper plate member serving to support said rod means and a motor means;

a motor means for rotating a drive shaft extending to said platform;

a linear actuator associated with said platform for translating rotation of said drive shaft into longitudinal movement of said platform;

a guide shaft extending from the upper plate member to said platform for guiding longitudinal movement of the platform; and linearly connected pivot bearings for providing a pivotal axis for the platform and the upper plate member.

10. The apparatus of claim 2, wherein said feeding means comprises apparatus having:

a pair of axially spaced endless belts;

generally semi-cylindrical elongated wrapper and article carrying members extending between and movable by the belts;

a first push means for laterally pushing the wrapped articles into the receiving means; and further comprising a second push means for pushing articles received from the ejecting means from the carrying members to further article handling apparatus.

11. The apparatus of claim 10 further comprising:

control means wherein said ejecting means and said feeding means are controlled in response to the presence of articles in the receiving means and in a carrier member opposite the receiving means.

12. The apparatus of claim 10 further comprising control means wherein:

an unwrapping sequence is initiated in response to presence in the receiving means of wrapped articles.

* * * * *